US007172028B2

(12) United States Patent
Barbee et al.

(10) Patent No.: US 7,172,028 B2
(45) Date of Patent: Feb. 6, 2007

(54) RECIPROCATING SLICKLINE PUMP

(75) Inventors: Phil Barbee, Harvey, LA (US); Corey E. Hoffman, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 173 days.

(21) Appl. No.: 10/737,703

(22) Filed: Dec. 15, 2003

(65) Prior Publication Data

US 2005/0126791 A1 Jun. 16, 2005

(51) Int. Cl.
*E21B 33/1295* (2006.01)
*E21B 23/04* (2006.01)

(52) U.S. Cl. ..... 166/383; 166/68; 166/106

(58) Field of Classification Search ..... 166/373, 166/383, 68, 106, 328
See application file for complete search history.

(56) References Cited

U.S. PATENT DOCUMENTS 2,217,043 A * 10/1940 Boynton ..... 175/42
2,624,412 A * 1/1953 Ragan ..... 166/120
2,695,065 A * 11/1954 Baker et al. ..... 166/63
2,703,623 A * 3/1955 Baker ..... 166/122
2,829,716 A * 4/1958 Stewart ..... 166/98
2,942,666 A * 6/1960 Boer et al. ..... 166/135
2,966,121 A * 12/1960 Crowl ..... 92/87
3,134,441 A * 5/1964 Barry et al. ..... 277/333
3,139,140 A * 6/1964 Brown ..... 166/120
3,176,304 A * 3/1965 Carlton et al. ..... 346/33 WL
3,344,861 A * 10/1967 Claycomb ..... 166/120
3,510,234 A * 5/1970 Wolf ..... 417/450
3,926,254 A * 12/1975 Evans et al. ..... 166/106
3,926,260 A * 12/1975 Slator ..... 166/385
4,139,334 A 2/1979 Payne et al.
4,190,113 A * 2/1980 Harrison ..... 166/311
4,505,155 A 3/1985 Jackson
4,592,421 A 6/1986 Hoffmann et al.
4,940,092 A * 7/1990 Ferguson et al. ..... 166/311
5,228,519 A * 7/1993 Coronado et al. ..... 166/387
5,660,534 A 8/1997 Snow
5,791,412 A * 8/1998 Myhre ..... 166/106
6,371,008 B1 4/2002 Djelouah
6,497,561 B2 * 12/2002 Skillman ..... 417/554
6,915,856 B2 * 7/2005 Gentry et al. ..... 166/382

FOREIGN PATENT DOCUMENTS

EP 0 518 371 12/1992
GB 2 337 065 11/1999

OTHER PUBLICATIONS

U.K. Search Report, Application No. GB0427401.5, dated Mar. 22, 2005.

* cited by examiner

*Primary Examiner*—Jennifer H Gay
(74) *Attorney, Agent, or Firm*—Patterson & Sheridan, LLP

(57) ABSTRACT

A reciprocating hydraulic slickline pump for use in a wellbore. The pump comprises a pump member. The pump member is reciprocated axially by slickline in order to form an upstroke and downstroke. The pump is configured such that it pressurizes fluid within a workstring assembly during the pump's downstroke.

26 Claims, 5 Drawing Sheets

RECIPROCATING SLICKLINE PUMP

BACKGROUND OF THE INVENTION

1. Field of the Invention

The present invention generally relates to hydraulically actuated downhole tools. More particularly, the invention relates to pumping apparatus used for activating downhole tools by providing pressurized fluid. More particularly still, embodiments of the invention pertain to a reciprocating hydraulic slickline pump.

2. Description of the Related Art

It is often necessary to deploy and actuate downhole equipment and tools, including packers and bridge plugs, during the completion or remediation of a well. Downhole hardware may be deployed and actuated using various conveying members including drill pipe, coiled tubing or spoolable line, such as wireline and slickline. Drill pipe and coiled tubing are physically larger and have greater strength than wireline and slickline. However, the cost and time requirements associated with procuring and running drill pipe or coiled tubing are much greater than those of spoolable line. Therefore, whenever appropriate, use of spoolable line is preferred.

Wireline and slickline are among the most utilized types of spoolable line. Wireline consists of a composite structure containing electrical conductors in a core assembly which is encased in spirally wrapped armor wire. Typically, wireline is used in applications where it facilitates the transportation of power and information between downhole equipment and equipment at the surface of the well.

Slickline, on the other hand, is mainly used to transport hardware into and out of the well. Slickline, designed primarily for bearing loads, is of much simpler construction and does not have electrical conductors like those in wireline. Instead, slickline is a high quality length (sometimes up to 10,000 feet or more) of wire which can be made from a variety of materials, (from mild steel to alloy steel) and is produced in a variety of sizes. Typically, slickline comes in three sizes: 0.092; 0.108; and 0.125 inches in diameter. For larger sizes, a braided wire construction is utilized. The braided wire, for all practical purposes, has similar functional characteristics as a solid wire. Such braided wire is considered to be slickline herein.

As stated above, use of wireline and slickline for deploying and actuating downhole tools is preferred over the use of drill pipe and coiled tubing due to the relatively low expense. Further, use of slickline is preferred over wireline, because slickline based systems are simpler and less expensive than wireline.

Many of the tools deployed during well completion and remediation, such as packers and bridge plugs, for example, are actuated by fluid pressure. Often, downhole pumps are utilized to provide the increased pressure. Use of electric pumps run on wireline is common, but the pumps are complex and very expensive.

Therefore, there is a need for a simple and reliable hydraulic pump that can be run on slickline and can be used to deploy hydraulically actuated tools. There is a further need for the pump to be operated by axially reciprocating the slickline.

SUMMARY OF THE INVENTION

In one aspect, the present invention includes a downhole pump that includes a source of fluid at a first pressure, a chamber for selectively increasing the pressure of the fluid in the chamber, a first flow path permitting the fluid at the first pressure to enter the chamber, and a second flow path permitting the fluid to exit the chamber at a second, higher pressure. The pump also includes a pump member movable relative to the chamber to change the volume thereof and the pressure therein, the pump member being operatively connected to a conveying member.

In another aspect, the present invention provides a method for pumping fluid in a wellbore. The method includes providing a pump with a source of fluid, a chamber, a plunger, a first valve, and a second valve. The method also includes remotely manipulating the plunger to change the pressure of the fluid in the chamber and causing the second valve to open and the first valve to close.

In yet another aspect, the present invention provides a method for transferring fluid in a wellbore. The method includes providing a downhole pump, with a source of fluid, that is operatively connected to a conveying member. The method also includes remotely actuating the pump by manipulating the conveying member and causing fluid to be transferred to a downhole tool.

BRIEF DESCRIPTION OF THE DRAWINGS

So that the manner in which the above recited features, the advantages and objects for the present invention can be more fully understood, certain embodiments of the invention are illustrated in the appended drawings.

DETAILED DESCRIPTION OF THE PREFERRED EMBODIMENT

The apparatus and methods of the present invention allow for the actuation of downhole tools such as packers and bridge plugs using a hydraulic pump run on slickline and operated by reciprocating the slickline.

The discussion below focuses primarily on utilizing slickline to deploy and actuate downhole tools such as packers and bridge plugs. The principles of the present invention also allow for the use of other spoolable line type conveying members including wireline, and swab line.

Figure 1:
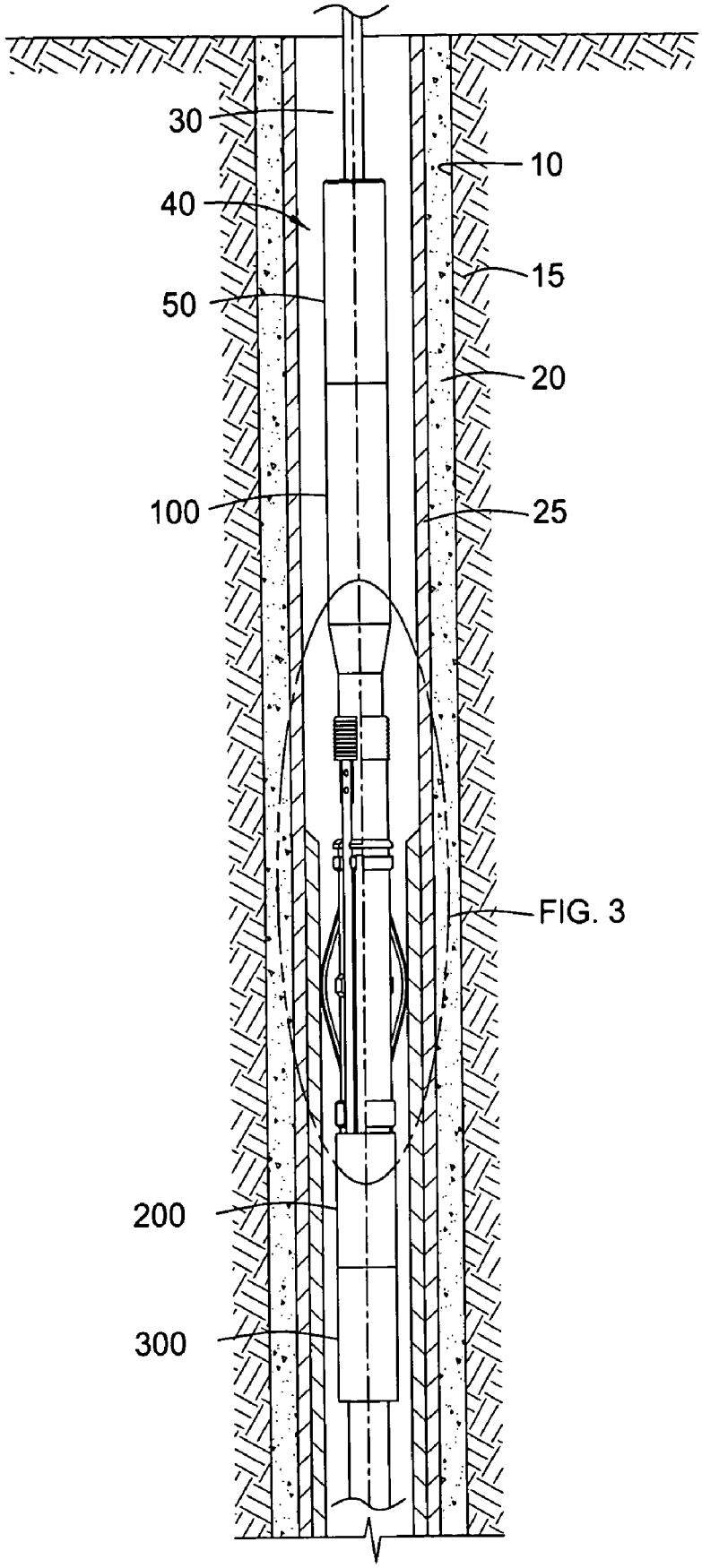
FIG. 1 is a cross-sectional view of a wellbore illustrating the slickline pump of the present invention lowered into the wellbore as a part of a downhole assembly.

FIG. 1 presents a cross-sectional view of a wellbore 10. As illustrated, the wellbore 10 has a string of casing 25 fixed in formation 15 by cured cement 20. The wellbore 10 also includes an axially reciprocating slickline pump 100 of the present invention, in a first embodiment.

The pump 100 is shown as a component of a work string assembly 40 that is threadedly connected to slickline 30 above. The slickline 30 is provided and controlled from a surface slickline unit (not shown). Along with the slickline pump 100, the work string assembly 40 comprises weight stem 50, one or more hydraulic multipliers 200, and a downhole tool 300, such as a packer or bridge plug that will be set or actuated or both. All components of the work string assembly 40 may be threadedly connected to each other.

Depending on the type of pump anchoring system used, a downward force parallel to the axis of the wellbore may be required to position the workstring assembly 40 at the desired location in the wellbore. Further, another downward force is needed to operate the pump 100. Due to the characteristics of cables, slickline can only exert an upward force on the work string assembly 40 based on the tension in the line. A downward force can not be provided by slickline, alone. However, with the use of weighted members, or weight stem 50, the desired amount of downforce can be applied by choosing the appropriate combination of weight stem 50 in the work string assembly 40 and tension in the slickline 30.

For example, suppose the workstring assembly 40 is anchored and is no longer supported axially by the slickline 30. Further suppose the weight stem weighs 5000 lbs and a 2000 lbs downward force is needed to properly stroke the pump 100. The tension in the slickline is 5000 lbs, based on the weight of the weight stem. During the downstroke, a tension of only 3000 lbs would be maintained. As a result, the remaining 2000 lbs of weight stem that has not been counteracted by tension in the slickline 30, provides a downward force on the pump 100. On the upstroke, the tension in the slickline would be raised to 5000 lbs, which accounts for all the weight of the weight stem, allowing the pump to extend completely.

The pump 100 is located directly below the weight stem 50. The pump 100 transforms the reciprocating motion, consisting of downstrokes and upstrokes, and produces a hydraulic pressure that is relayed to the remainder of the work string assembly 40 below. Components of the pump 100 and its operation are discussed in detail in a later section.

The pressure produced by the pump 100, may not be adequate to actuate the downhole tool 300. Therefore, for the purposes of amplifying the pressure produced by the pump 100, one or more hydraulic multipliers 200 may be connected below the pump 100. Hydraulic multipliers 200 are commonly known in the industry for taking an intake pressure and producing a higher pressure as output. The number of multipliers 200 used depends on the desired pressure increase.

The downhole tool 300 to be deployed and actuated is located below the hydraulic multipliers 200. For the embodiment shown, the downhole tool is an inflatable packer. Those skilled in the art will recognize that a variety of tools activated by pressure may be set or actuated by the pump 100 of the present invention. As used herein, the terms downhole tool may refer to an array of tools including packers and bridge plugs.

Figure 2:
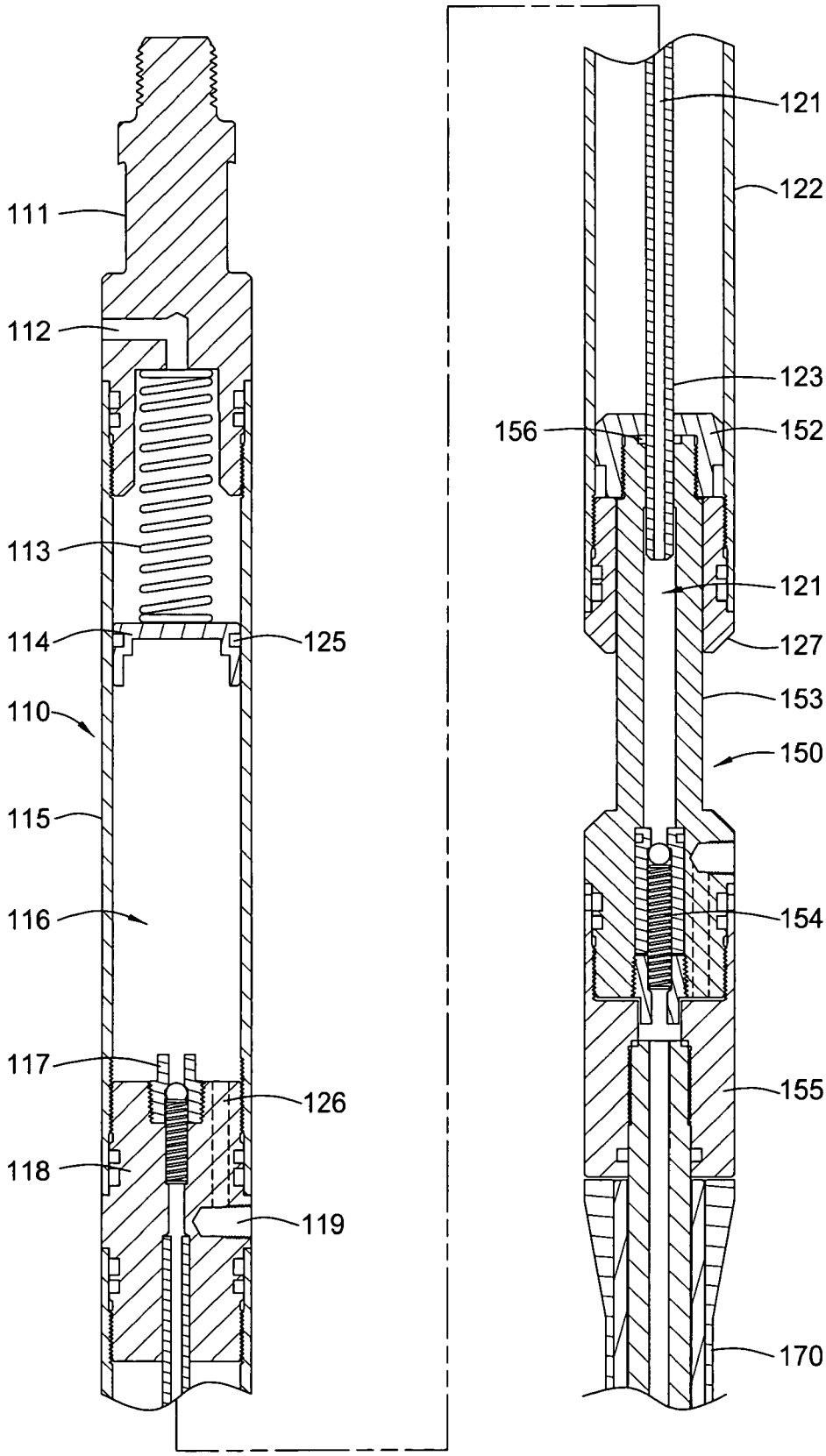
FIG. 2 is a cross-sectional view of one embodiment of a slickline pump of the present invention.

A cross-sectional view of the slickline pump 100 is shown in greater detail in FIG. 2. As illustrated in FIG. 2, the pump 100 comprises a barrel assembly 110, mandrel assembly 150, and an anchor assembly 170.

Located at the top of the barrel assembly 110 is a top sub 111 that is used to threadedly connect the pump 100 to the weight stem 50 members above. An upper barrel 115 is threadedly connected below the top sub 111. A barrel sub 118 is positioned below the upper barrel 115 and above a lower barrel 122; the barrel sub 118 is threadedly connected to both the upper barrel 115 and lower barrel 122. At the bottom of the barrel assembly 110, a barrel stop 127 is threadedly connected to the lower barrel 122.

A piston spring 113 and floating piston 114 are located within the area bounded by the top sub 111, barrel sub 118, and upper barrel 115. The lower portion of the top sub 111 contains a downward facing bore that accepts the piston spring 113. The top sub 111 also includes a vent 112 designed to allow wellbore fluid, pressurized due to the hydrostatic head, into the top sub 111. A piston seal 125 is provided to ensure the pressurized wellbore fluid remains above the floating piston 114.

The region between the floating piston and the barrel sub 118 is filled with fluid forming a fluid reservoir 116. In one embodiment, the fluid used may be hydraulic fluid. During assembly of the pump 100, hydraulic fluid is added to the fluid reservoir 116 via a port 126 in the barrel sub 118. After the desired amount of fluid is added, a plug 119 is inserted to close the port 126 and retain the fluid.

The piston spring 113, assisted by the wellbore fluid above the floating piston 114, provides a constant force on the floating piston 114, which in turn will ensure the fluid reservoir 116 is pressurized to a level greater than or equal to the hydrostatic head. Even though the pressure of the fluid reservoir is increased it will not be high enough to open an upper check valve 117 located within the barrel sub 118. The upper check valve 117 assembly comprises a ball, ball seat, and spring. In this specification, check valves are intended to permit fluid travel only in one direction. Operation of the upper check valve 117 will be described in detail in a later section.

In another embodiment (not shown), the fluid reservoir 116 may not be isolated from the wellbore 10. Instead, wellbore fluid may be utilized as the fluid within the fluid reservoir 116. The barrel sub 118 can be configured to accept a one-way valve, which would allow wellbore fluid to enter (but not leave) the fluid reservoir 116 via the one-way valve. Filters may also be added to prevent debris present in the wellbore from entering the fluid reservoir 116.

A pump member is used to facilitate fluid and pressure communication between the barrel assembly 110 and mandrel assembly 150 below. For the current embodiment, the pump member is a plunger 123 that is connected to the bottom of the barrel sub 118. Further, the plunger 123 is press fit into the central bore of the barrel sub 118. In other embodiments, the plunger 123 may be threadedly connected to the barrel sub 118.

The interface between the mandrel assembly and the barrel assembly is such that the annulus formed between the exterior of the plunger 123 and the interior of the lower barrel 122 is not pressurized. Fluid channels in the barrel stop 127 are provided to allow wellbore fluid to travel freely in and out of the area. Therefore, the fluid pressure in this region is equal to the wellbore pressure at all times.

Located below the barrel assembly 110, is the mandrel assembly 150. The mandrel assembly 150 comprises a mandrel stop 152, mandrel 153, and bottom sub 155.

The mandrel 153 contains a bore that allows the plunger 123 of the barrel assembly 110 to slidably move along the axis of the pump 100 within the bore of the mandrel 153. The mandrel 153 also comprises a lower check valve 154, consisting of a ball, ball seat, spring, and spring seat. The lower check valve 154 is located at the bottom of the mandrel 153. A pressure chamber 121 comprising the volume bounded by the upper check valve 117, lower check valve 154, and the plunger 123 bore and mandrel 153 bore. During the operation of the pump 100, the size of the pressure chamber 121 varies as the pump 100 is reciprocated.

A bottom sub 155, constructed with two sets of threads, is threadedly connected to the bottom of the mandrel 153. One set of threads is designed to connect the mandrel to the bottom sub, while the second set of threads is designed to connect the mandrel assembly 150 to the anchor assembly 170 below.

Figure 3:
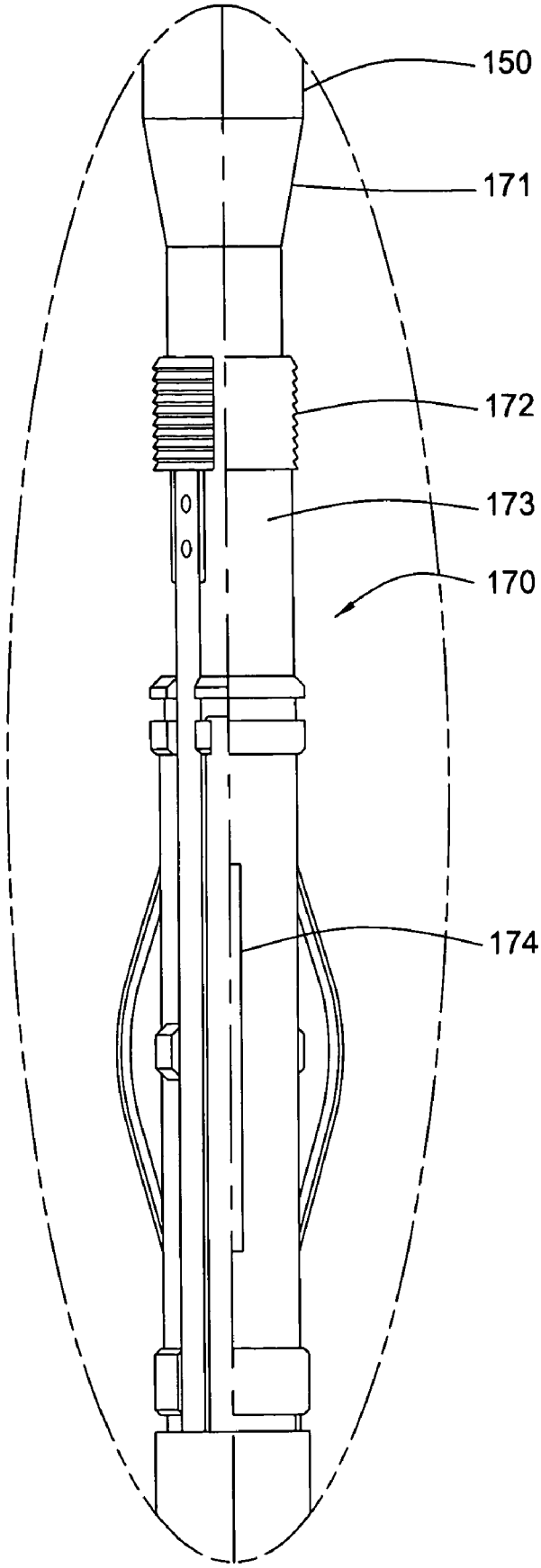
FIG. 3 is a cross-sectional view of one embodiment of an anchor assembly of the slickline pump of the present invention.

FIG. 3 illustrates one embodiment of an anchor assembly 170. The anchor assembly of this embodiment comprises a cone 171, anchor mandrel 173, centralizer springs 174 and slips 172. The purpose of the anchor assembly 170 is to hold the mandrel assembly 150, and the remainder of the work string assembly 40 below the anchor 170, stationary. In this manner, the anchor assembly 170 allows axial movement of the barrel assembly 110 (along with the work string assembly components above it) relative to the stationary mandrel assembly 150.

As illustrated in FIG. 3, slips 172 with teeth and bow springs 174 are disposed about the anchor sleeve 175. The anchor sleeve 175 slidably moves along the anchor mandrel 173. The anchor assembly 170 also includes a cone 171 at the top of the anchor mandrel 173. The slips 172 and bow springs 174 are constructed and arranged to mechanically grip the inside of the casing as the anchor sleeve 175 slidably moves up relative to the cone 171 and anchor mandrel 173. When the slips 172 and springs 174 sufficiently engage (prevent movement of the anchor 170) the casing, the anchor assembly is set.

In some embodiments, the anchor assembly 170 may be a set of spacers or tubular extensions without any gripping members. In other embodiments, the anchor assembly 170 may be left out altogether. In yet another embodiment, the hydraulic multipliers may be threadedly connected directly below the mandrel assembly, and the bottom sub may be left out altogether. The type of anchor assembly used depends upon factors such as the type of hardware already in the well, and the type of downhole tool being deployed.

Figure 4A:
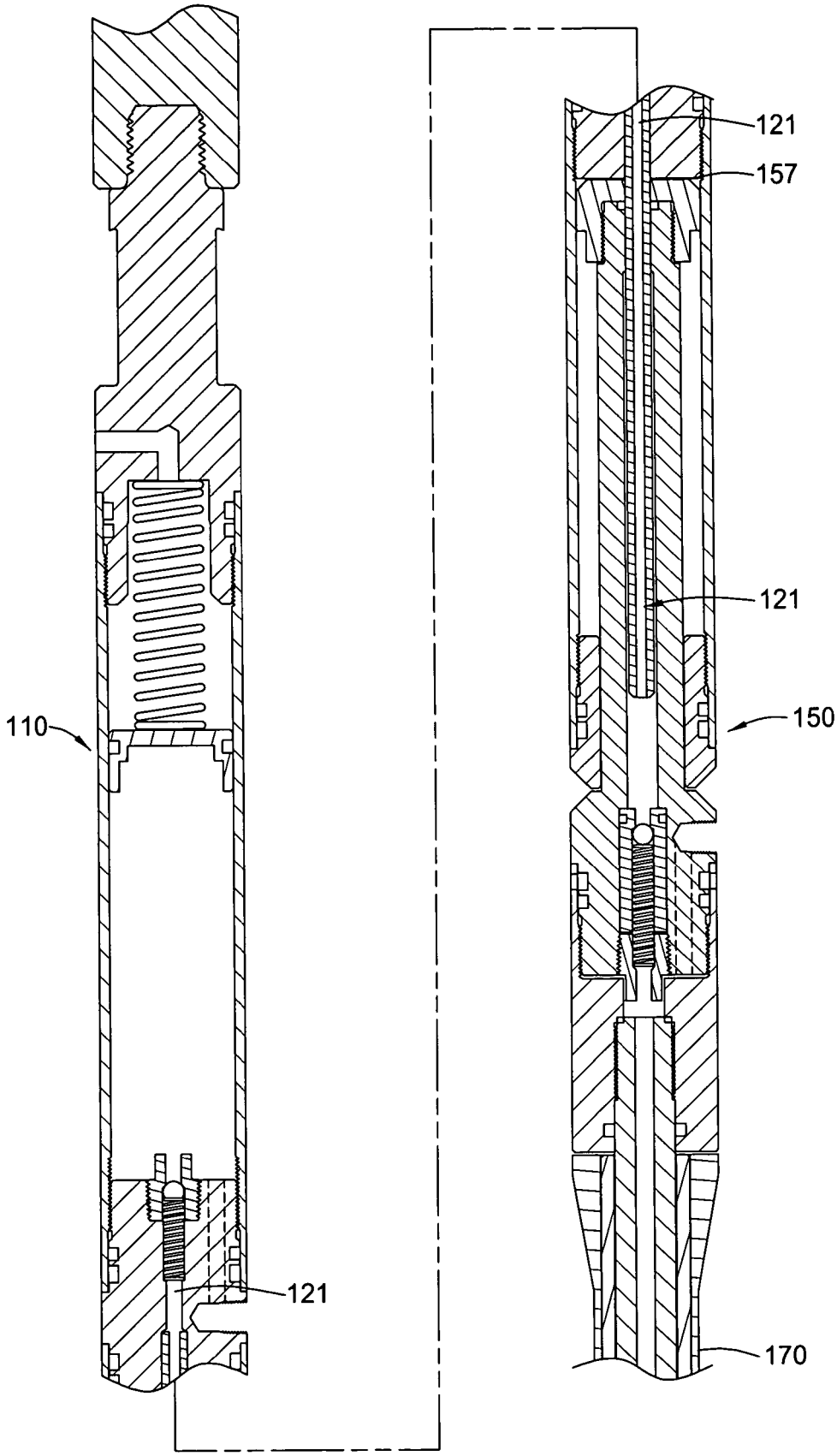
FIG. 4A is a cross-sectional view of the slickline pump in the fully compressed position.
Figure 4B:
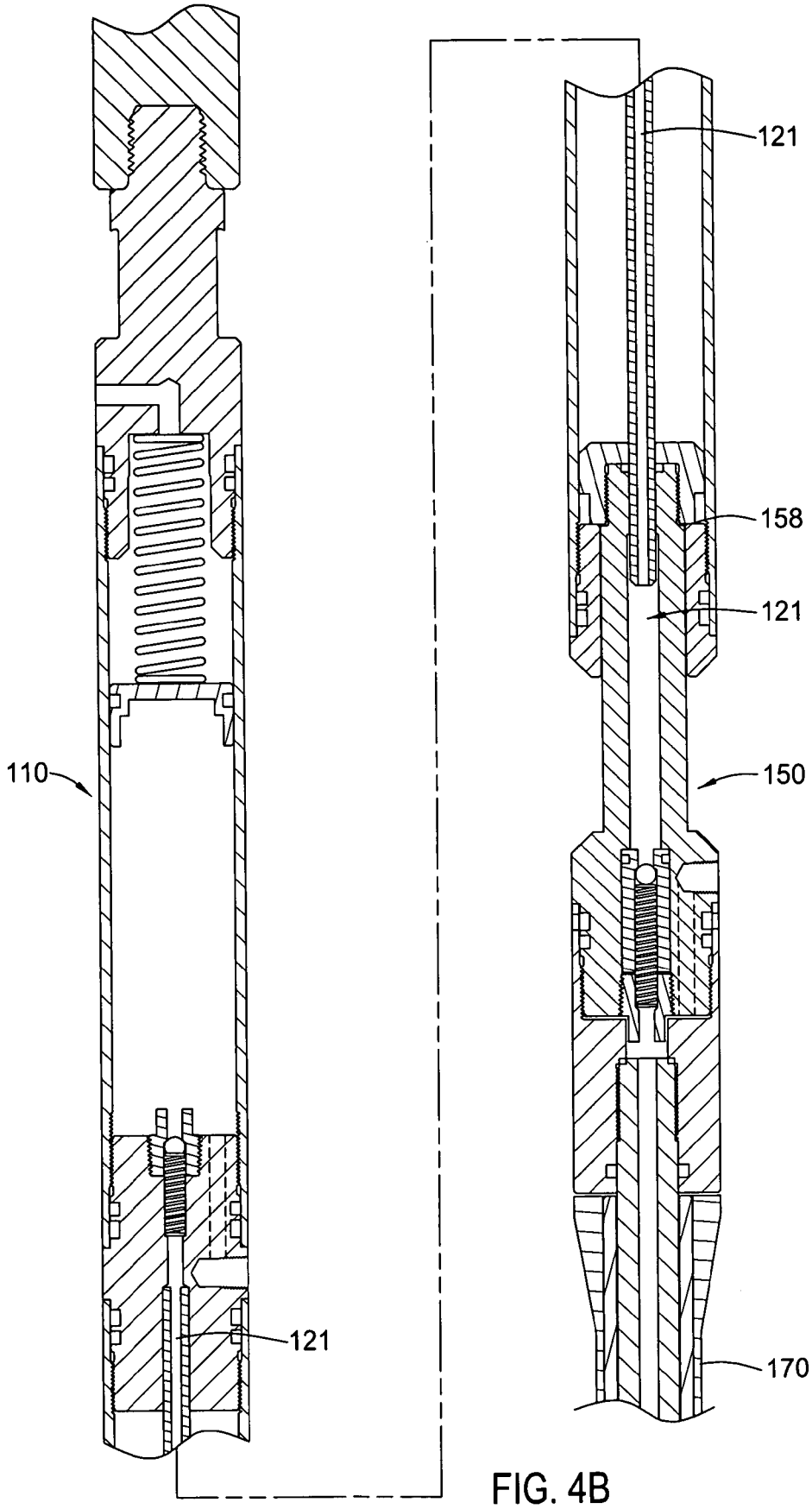
FIG. 4B is a cross-sectional view of the slickline pump in the fully extended position.

In operation, the slickline pump reciprocates between the compressed and extended positions, as illustrated in FIGS. 4A and 4B. Prior to the actuation of the pump 100, however, the workstring assembly 40 (shown in FIG. 1) is lowered to the desired position and the anchor assembly is set. After the anchor assembly is set, relative axial movement between the barrel assembly and the mandrel assembly is possible. The slickline pump 100 can be operated by reciprocating the slickline. As described earlier, any required downforce, for setting the anchor assembly or reciprocating the tool is provided by using a technique of utilizing weight stem members and varying the amount of tension in the slickline.

In response to the movement of the slickline and weight stem members above, the barrel assembly reciprocates relative to the mandrel assembly along the longitudinal axis of the tool. The reciprocated motion comprises a series of alternating upstrokes and downstrokes. In this specification, the term downstroke refers to motion of the pump towards the compressed position, while upstroke refers motion of the pump towards the extended position.

In order to produce an upstroke, the tension in the slickline needs to be slightly greater than the weight of the weight stem. If the slickline is under too much tension, however, the entire work string assembly, including the anchor assembly all components below, may by pulled uphole and out of the desired position. In order to produce a downstroke, tension in the slickline is reduced to less than the weight of the weight stem members. This way, the weight stem imparts a downward force on the barrel assembly of the pump 100.

FIG. 4A illustrates the slickline pump 100 in the completely compressed position. During the downstroke, the pressure chamber's 121 volume is decreased, which, in turn, causes the pressure in the chamber 121 to significantly increase. The increased pressure in the chamber 121 forces the upper check valve 117 to remain closed, but the lower check valve 154 opens allowing the region below to be pressurized to the same pressure as that in the chamber 121. The lower check valve 154 remains open until the end of the downstroke. The end of the downstroke is reached when the downward motion of the barrel assembly is impeded as the bottom shoulder of the barrel sub 118 comes in contact with the upper surface 157 of the mandrel stop.

FIG. 4B illustrates the slickline pump 100 in the completely extended position. During the upstroke, the volume comprising the pressure chamber 121 increases and, correspondingly, the pressure in the chamber 121 drops below the pressure in the fluid reservoir 116. Consequently, the lower check valve 154 remains closed, but the upper check valve 117 opens allowing fluid to flow from the reservoir 116 to the pressure chamber 121. The upper check valve 117 remains open until the end of the upstroke. The end of the upstroke is reached when the upper surface of the barrel stop 127 comes in contact with the mandrel stop's lower surface 158.

As the pump 100 reciprocates, it continues to transfer pressurized fluid to the components of the work string assembly below. The fluid pressure is further increased via the hydraulic multipliers. Once the fluid pressure is increased adequately, the downhole tool included in the work string assembly can be deployed and actuated as desired.

While the foregoing is directed to embodiments of the present invention, other and further embodiments of the invention may be devised without departing from the basic scope thereof, and the scope thereof is determined by the claims that follow.

The invention claimed is:

1. An assembly for pumping fluid comprising:

a conveying member selected from a group consisting of slickline, braided line, wireline, swab line, and combinations thereof; and a downhole pump configured to direct fluid exiting the pump to a downhole tool, the fluid comprising hydraulic fluid and the pump comprising:

a first valve;

a second valve; and a pump member, the pump member being operative in response to axial reciprocation of the conveying member.

2. The assembly of claim 1, wherein the first valve is a check valve permitting fluid flow in only one direction.

3. The assembly of claim 1, wherein the second valve is a check valve permitting fluid flow in only one direction.

4. The assembly of claim 1, further comprising an anchor assembly configured to hold a downhole tool and a portion of the downhole pump stationary relative to the pump member and the conveying member.

5. The assembly of claim 4, wherein the anchor assembly comprises bow springs.

6. The assembly of claim 4 wherein the anchor assembly comprises slips.

7. The assembly of claim 4, wherein the anchor assembly comprises a high expansion anchor.

8. The assembly of claim 1, further including a hydraulic multiplier configured to increase the pressure of the fluid exiting the pump.

9. The assembly of claim 1, further including a fluid reservoir configured to store fluid for use in the downhole pump.

10. A method for pumping fluid in a wellbore comprising:

providing a pump with a chamber, a plunger, a first valve, and a second valve, wherein the pump is operatively connected to a conveying member selected from a group consisting of slickline, braided line, wireline, swab line, and combinations thereof;

providing a source of fluid, wherein the source fluid comprises hydraulic fluid;

axially reciprocating the conveying member thereby causing the pump to change the pressure of the fluid in the chamber;

causing the second valve to open and the first valve to close; and directing the fluid exiting the pump to a downhole tool.

11. The method of 10, further comprising remotely extending the plunger to decrease the pressure of the fluid in the chamber, thereby causing the first valve to open and the second valve to close.

12. The method of 10, further comprising positioning the pump by setting an anchor.

13. The method of claim 10, wherein the pump is lowered into the wellbore using the conveying member.

14. A method for transferring fluid in a wellbore comprising:

providing a downhole pump with a source of fluid, that is operatively connected to a conveying member selected from a group consisting of slickline, braided line, wireline, swab line, and combinations thereof, wherein the source fluid comprises hydraulic fluid;

remotely actuating the pump by axially reciprocating the conveying member; and causing fluid exiting the pump to be directed to a downhole tool.

15. The method of claim 14, wherein the source fluid further comprises wellbore fluid.

16. The method of claim 14, further including increasing the pressure of the fluid exiting the pump.

17. A downhole pumping system comprising:

a first flow path permitting a hydraulic fluid at a first pressure to enter the pumping system;

a second flow path permitting the hydraulic fluid to exit the pumping system at a second, higher pressure, wherein the hydraulic fluid exiting the pump system is directed to a down hole tool; and the pumping system being operatively connected to a conveying member selected from a group consisting of slickline, braided line, wireline, swab line, and combinations thereof, wherein the pumping system is operative in response to axial reciprocation of the conveying member.

18. The pump of claim 17, further including a variable volume chamber.

19. The pump of claim 17, wherein the first flow path includes a check valve.

20. The pump of claim 17, wherein the second flow path includes a check valve.

21. The pump of claim 17, wherein fluid stored in a source chamber is a source of the fluid.

22. The pump of claim 21, wherein the source chamber is a variable volume chamber with a biased member for carrying the fluid towards a first check valve.

23. The pump of claim 17, further including a plunger having a fluid path therethrough for passing of the fluid between a source and a chamber.

24. The pump of claim 17, wherein the downhole tool is selected from the group consisting of a packer, bridge plug, cement retainer, and combinations thereof.

25. The pump of claim 17, wherein fluid exiting the pump system actuates a downhole tool.

26. The pump of claim 25, wherein the downhole tool is selected from the group consisting of a packer, bridge plug, cement retainer, and combinations thereof.

* * * * *

UNITED STATES PATENT AND TRADEMARK OFFICE

CERTIFICATE OF CORRECTION

PATENT NO. : 7,172,028 B2
APPLICATION NO. : 10/737703
DATED : February 6, 2007
INVENTOR(S) : J. Tims Red, Phil Barbee and Corey E. Hoffman It is certified that error appears in the above-identified patent and that said Letters Patent is hereby corrected as shown below:

Title Page;
On the front page of the patent, please correct as follows:

(75) Inventors: J. Tims Red, Carriere, MS (US); Phil Barbee, Harvey, LA (US); Corey E. Hoffman, Magnolia, TX (US).

Signed and Sealed this

Sixth Day of May, 2008

JON W. DUDAS
*Director of the United States Patent and Trademark Office*